US007428899B2

(12) United States Patent
Andresen

(10) Patent No.: US 7,428,899 B2
(45) **Date of Patent: *Sep. 30, 2008**

(54) DEVICE FOR STORING PROJECTILE BALLS AND FEEDING THEM INTO THE PROJECTILE CHAMBER OF A GUN

(75) Inventor: Heddies Andresen, Quickborn (DE)

(73) Assignee: KEE Action Sports I LLC, Sewell, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/965,384

(22) Filed: Oct. 14, 2004

(65) Prior Publication Data

US 2006/0081233 A1 Apr. 20, 2006

(51) Int. Cl.
*F41B 11/02* (2006.01)

(52) U.S. Cl. ..... 124/51.1; 124/48; 124/52

(58) Field of Classification Search ..... 124/48, 124/51.1, 52, 53

See application file for complete search history.

(56) References Cited

U.S. PATENT DOCUMENTS

| | | | |
|---|---|---|---|
| 1,403,719 | A | 1/1922 | Szepe |
| 1,404,689 | A | 1/1922 | Fairweather |
| 1,743,576 | A | 1/1930 | Smith |
| 1,867,513 | A | 7/1932 | Lahti |
| 2,307,015 | A | 1/1943 | Boynton |
| 2,357,951 | A | 9/1944 | Hale |
| 2,398,263 | A | 4/1946 | Trimbach |
| 3,248,008 | A | 4/1966 | Meierjohan |

(Continued)

FOREIGN PATENT DOCUMENTS

| | | |
|---|---|---|
| DE | 3 721 527 | 5/1989 |

(Continued)

OTHER PUBLICATIONS

European Search Report.

(Continued)

*Primary Examiner*—John Ricci
(74) *Attorney, Agent, or Firm*—Volpe and Koenig P.C.

(57) ABSTRACT

The invention relates to a device for feeding ball-like ammunition, so-called paint balls, into the projectile chamber of a sporting arm. The magazine is arranged separately from the arm and is connected to same by means of a feeder tube. A motor-driven feeder feeds the balls from the ball container into the feeder tube. In so doing, a spring element stores the traction from the motor, so that, even when the motor stops, balls can still be transported using the energy stored in the spring element. The traction from the motor is transmitted via a connection or clutch consisting of a spring element and a transmission element. Protrusions are arranged on both the spring element and the transmission element, which come to bear on each other for transmitting traction. The protrusions are at least partially flexible, so that the transmitted force is limited. This way, explosion of the balls from excessive pressure is prevented. In addition, the feeder is connected with the drive element for the feeder, which is under pressure from the spring, by means of a bayonet-like connection. This way, the feeder can be removed from the ball container with one manipulation to facilitate the cleaning of the ball container in the event a ball explodes in spite of this.

19 Claims, 2 Drawing Sheets

U.S. PATENT DOCUMENTS 3,467,073 A 9/1969 Rhodes
3,610,223 A 10/1971 Green
3,695,246 A 10/1972 Filippi et al.
3,788,298 A 1/1974 Hale
3,844,267 A 10/1974 Mohr
3,855,988 A 12/1974 Sweeton
3,867,921 A 2/1975 Politzer
4,185,824 A 1/1980 Natwick
4,207,857 A 6/1980 Balka, Jr.
4,332,097 A 6/1982 Taylor, Jr.
4,646,709 A 3/1987 Kholin
4,819,609 A 4/1989 Tippmann
4,896,646 A 1/1990 Kahelin et al.
4,926,742 A 5/1990 Ma et al.
4,930,400 A 6/1990 Brandl et al.
4,936,282 A 6/1990 Dobbins et al.
4,951,548 A 8/1990 Wixon et al.
4,951,644 A 8/1990 Bon
4,965,951 A 10/1990 Miller et al.
4,986,251 A 1/1991 Lilley
4,993,400 A 2/1991 Fitzwater
5,063,905 A 11/1991 Farrell
5,097,816 A 3/1992 Miller
5,097,985 A 3/1992 Jones
5,166,457 A 11/1992 Lorenzetti
5,282,454 A 2/1994 Bell et al.
5,335,579 A 8/1994 David
5,353,712 A 10/1994 Olson
5,383,442 A 1/1995 Tippmann
5,456,153 A 10/1995 Bentley et al.
5,490,493 A 2/1996 Salansky
5,497,758 A 3/1996 Dobbins et al.
5,505,188 A 4/1996 Williams
5,511,333 A 4/1996 Farrell
5,520,171 A 5/1996 David
5,542,570 A 8/1996 Nottingham et al.
5,561,258 A 10/1996 Bentley et al.
5,600,083 A 2/1997 Bentley et al.
5,722,383 A 3/1998 Tippmann, Sr. et al.
5,727,538 A 3/1998 Ellis
5,736,720 A 4/1998 Bell et al.
5,749,797 A 5/1998 Sunseri et al.
5,771,875 A 6/1998 Sullivan
5,784,985 A 7/1998 Lodico et al.
5,791,325 A 8/1998 Anderson
5,794,606 A 8/1998 Deak
5,809,983 A 9/1998 Stoneking
5,816,232 A 10/1998 Bell
5,839,422 A 11/1998 Ferris
5,881,962 A 3/1999 Schmidt et al.
5,887,578 A 3/1999 Backeris et al.
5,947,100 A 9/1999 Anderson
5,954,042 A 9/1999 Harvey
6,032,395 A 3/2000 Bentley et al.
6,055,975 A 5/2000 Gallagher et al.
6,109,252 A 8/2000 Stevens
6,206,562 B1 3/2001 Eyraud et al.
6,213,110 B1 4/2001 Christopher et al.
6,220,237 B1 4/2001 Johnson et al.
6,305,367 B1 10/2001 Kotsiopoulos et al.
6,327,953 B1 12/2001 Andresen
6,347,621 B1 2/2002 Guthrie
6,374,819 B1 4/2002 Ming-Hsien
6,408,837 B1 6/2002 Johnson et al.
D459,767 S 7/2002 Rushton
6,415,781 B1 7/2002 Perrone
6,418,919 B1 7/2002 Perrone
6,425,781 B1 7/2002 Bernstein et al.
6,460,530 B1 10/2002 Backeris et al.
6,467,473 B1 10/2002 Kostiopoulos
6,468,879 B1 10/2002 Lamure et al.
6,481,432 B2 11/2002 Rushton et al.
6,488,019 B2 12/2002 Kotsiopoulos
6,502,567 B1 1/2003 Christopher et al.
6,526,955 B1 3/2003 Juan
6,591,824 B2 7/2003 Hatcher
6,615,814 B1 9/2003 Rice et al.
6,644,293 B2 11/2003 Jong
6,684,873 B1 2/2004 Anderson
6,701,907 B2 * 3/2004 Christopher et al. ..... 124/48
6,708,685 B2 3/2004 Masse
6,725,852 B1 4/2004 Yokota
6,729,321 B2 5/2004 Ho
6,729,497 B2 5/2004 Rice et al.
6,739,322 B2 5/2004 Rice et al.
6,739,323 B2 5/2004 Tippmann, Jr.
6,742,512 B1 6/2004 Ho
6,752,137 B2 6/2004 Brunette
6,792,933 B2 9/2004 Christopher et al.
6,802,306 B1 10/2004 Rice
6,860,258 B2 3/2005 Farrell
6,889,680 B2 * 5/2005 Christopher et al. ..... 124/51.1
6,915,792 B1 7/2005 Sheng
6,981,493 B1 1/2006 Poteracke
7,017,569 B2 3/2006 Jong
7,021,302 B2 4/2006 Neumaster
7,159,585 B2 1/2007 Quinn et al.
2002/0014230 A1 2/2002 Christopher
2002/0020402 A1 2/2002 Kotsiopoulos
2002/0059927 A1 5/2002 Woods
2002/0117159 A1 8/2002 Kotsiopoulos
2003/0079731 A1 5/2003 Dobbins
2004/0074489 A1 4/2004 Neumaster
2004/0194772 A1 10/2004 Hamilton
2004/0211402 A1 10/2004 Christopher et al.
2005/0028801 A1 2/2005 Lewis
2005/0274370 A1 12/2005 Lubben
2005/0274371 A1 12/2005 Lubben
2006/0086347 A1 4/2006 Hedberg
2006/0249131 A1 11/2006 Broersma
2006/0254572 A1 11/2006 Hall
2007/0101981 A1 5/2007 Chen

FOREIGN PATENT DOCUMENTS

DE 43 43 871 A1 6/1994
DE 19922589 12/2000
EP 01054228 11/2000
EP 1653189 5/2006
GB 2 322 438 A 8/1998
WO WO98/13660 4/1998
WO WO01/44745 6/2001

OTHER PUBLICATIONS

English Abstract of German Reference DE 43 43 870 A1.

* cited by examiner

DEVICE FOR STORING PROJECTILE BALLS AND FEEDING THEM INTO THE PROJECTILE CHAMBER OF A GUN

BACKGROUND OF THE INVENTION

In the case of sporting arms with ball-like ammunition, so-called paint balls, the general problem is feeding the balls into the projectile chamber of the arm. In the simplest version, a magazine is mounted above the projectile chamber, from which the individual balls enter the projectile chamber through the force of gravity.

Also known is U.S. Pat. No. 6,327,953, whose disclosure is herewith included in the disclosure of the present application and whose characteristics are part of the disclosure of the present application. There, the magazine is arranged at a distance from the arm; it is carried in any other place. The transport of the ammunition from the magazine to the arm is by way of a long, flexible feeder tube not impairing the maneuverability of the arm. A motor-driven feeder exercises mechanical pressure on the balls so that the tube is constantly filled with balls and that new balls enter the feeder tube when the first ball is fed into the projectile chamber. To avoid constant operation of the motor, the motor transmits the traction to the feeder via a spring element. The spring element stores the traction force of the motor in such a way that balls can be transported into the ball chamber with the spring tension alone. This allows intermittent operation of the motor. The motor switches off when the spring element is loaded and switches on again only when the spring tension is used for feeding balls. The disadvantage of this type of construction is that controlling of the motor is difficult. If the motor does not switch off on time once the spring element is loaded and therefore the entire traction force is transmitted to the balls, there is the risk that individual balls will explode. The storage device is then no longer operational.

The invention concerns a storage device to reduce operational impairment from exploded balls. On the one hand, the purpose is to reduce the probability of damage to the balls, on the other hand-should the balls explode after all-the purpose is to restore operational readiness as soon as possible.

SUMMARY OF THE INVENTION

The solution according to the invention lies in features which provide for a device for storing balls and for feeding said balls into the ball chamber of a hand gun. A ball container is used for storing the balls, having a feeder tube attached to it which leads to the arm. A feeder is provided for feeding the balls into the feeder tube, the feeder being driven by a motor. When the motor is switched off, a spring device helps maintain the feeding pressure on the balls inside the tube whose spring travel is at least the magnitude of the diameter of the ball. This ensures that immediately following a discharge and opening of the projectile chamber, the spring tension pushes the next ball into the projectile chamber, this process not requiring any previous switching on of the feeder motor. The traction force of the motor which ensures the rotation of the feeder is transmitted to the feeder via a slip clutch, that limits torque transmission.

The slip clutch can comprise a transmission element and a spring element. The spring element is connected with the feeder in such a way that any rotation of the spring element causes a rotation of the feeder. For transmitting the force from the transmission element to the spring element, the transmission element is equipped with a number of protrusions. The protrusions are arranged concentrically with respect to the axle, at a distance from same. On one end, the spring element has a protrusion that bears against one of the protrusions of the transmission element. The transmission element is connected with the drive shaft of the motor and is set in motion by same. The rotation of the transmission element is transmitted to the feeder via the spring element.

The protrusions of the spring element and/or the protrusions of the transmission element are of a flexible kind. If the power transmission from the protrusions of the transmission element to the protrusion of the spring element becomes too great, the flexible protrusion bends in the direction of the force. The protrusions slip past each other and the protrusion of the spring element comes to bear on the next protrusion of the transmission element. This way, the torque that can be transmitted from the motor to the feeder is limited. The torque threshold at which the protrusions slip past each another, is set in such a way that the balls are not damaged.

Instead of providing one protrusion at the spring element and a number of protrusions on the transmission element, there is the other option of equipping the transmission element with one protrusion and the spring element with a number of protrusions, or equipping both with a number of protrusions. Nor is it absolutely necessary to reserve the feature of flexibility only to the transmission element. In fact, all protrusions may be flexible; however, either the protrusions of the spring element or those of the transmission element must be flexible.

If a ball is damaged in spite of these devices for limiting the force, for example in the case that said ball had a flaw, the storage device is to be restored to operational readiness as quickly as possible. For this, the feeder is connected through a bayonet-like connection with the drive element under load from the spring. This way, the feeder can be removed from the ball chamber with one manipulation, and the remainders of the destroyed ball can be simply removed from the ball chamber.

In general, loading the spring by the drive motor has the effect that the position of the protrusion of the feeder element changes in relation to the protrusion of the transmission element. The effect of this could be that the maximum possible power transmission from the spring element to the transmission element changes. In order to maintain the same position of the protrusions relative to one another, a distance holder can be provided. The distance holder swings freely around the same axle as the transmission element, thereby keeping the protrusion of the spring element at a constant distance from the axle.

It is essential that the ball, which is driven by the feeder into the feeder tube, moves along a defined path. If the ball is not on the defined path there is the risk that the ball is pushed against the edge of the entrance to the feeder tube instead of entering the feeder tube. The force of the feeder can damage the ball. To minimize the risk of damage the device can comprise a flexible element above the feeder adjacent to the feeder tube. The flexible element is fixed to the ball container with its one end. A ball that is not in the correct position relative to the feeder touches the flexible element, before it is pushed against the edge of the feeder tube. The flexible element deflects the ball back into the ball container.

As there is enough energy stored in the spring element for feeding the balls into the projectile chamber, it is not necessary for the motor to run all the time. Therefore, a device can be provided for intermittent switching-on of the motor, i.e., a device switching off the motor when the spring element is loaded, and switching it on again only when the spring element has transmitted energy to the balls. For all practical purposes, the device for intermittent switching on is dependent on the movement of the balls inside the feeder tube. The spring element transmits its force to the balls in the feeder tube; consequently, the movement of the balls in the feeder tube is a measure for the energy used by the spring element. The movement of the balls in the feeder tube is preferably determined by means of a sensor that is arranged on that end of the feeder tube which is adjacent to the hand gun. This sensor transmits a signal to the drive motor when it detects a movement of the balls.

The feeder can transport balls effectively only when it is ensured that the balls arrive in the feeder areas of the feeder. If the feeder is a rotary feeder in which the feeding chambers are located at the perimeter, a cone-shaped protrusion can be provided on the upper side of the feeder. Balls lying on this protrusion roll down its sides and come to rest in the feeder chambers.

BRIEF DESCRIPTION OF THE DRAWINGS

An exemplary embodiment of the invention is described below with reference to the figures in the annex, wherein.

DETAILED DESCRIPTION OF THE PREFERRED EMBODIMENT

Figure 1:
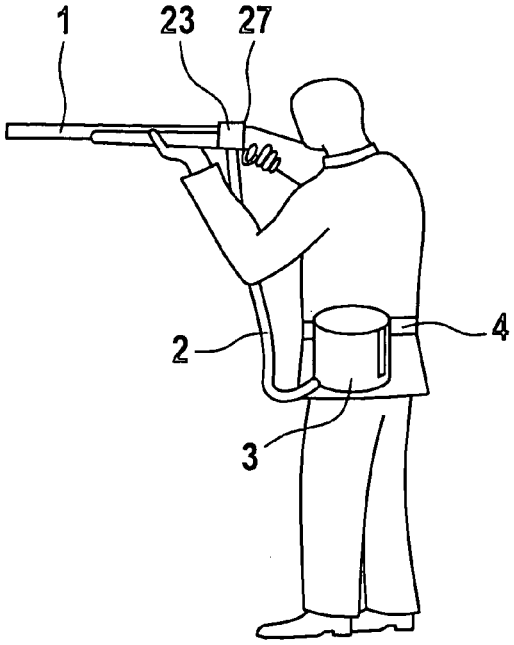
FIG. 1 shows the device according to the invention when being in use.

According to FIG. 1, a shooter uses an arm 1, for example an air gun for so-called paint balls, which is connected with a ball container 3 containing balls 14, through a flexible feeder tube 2. The balls 14 are fed in a continuous process through a feeder 8 (to be described below) to the projectile chamber of the gun 1. In this process, they are under pressure from a spring, so that every time a ball is fired and the empty projectile chamber opens, a new ball is fed from the feeder tube 2 into the projectile chamber. The ball container 3 is attached to the belt 4 of the shooter.

Figure 2:
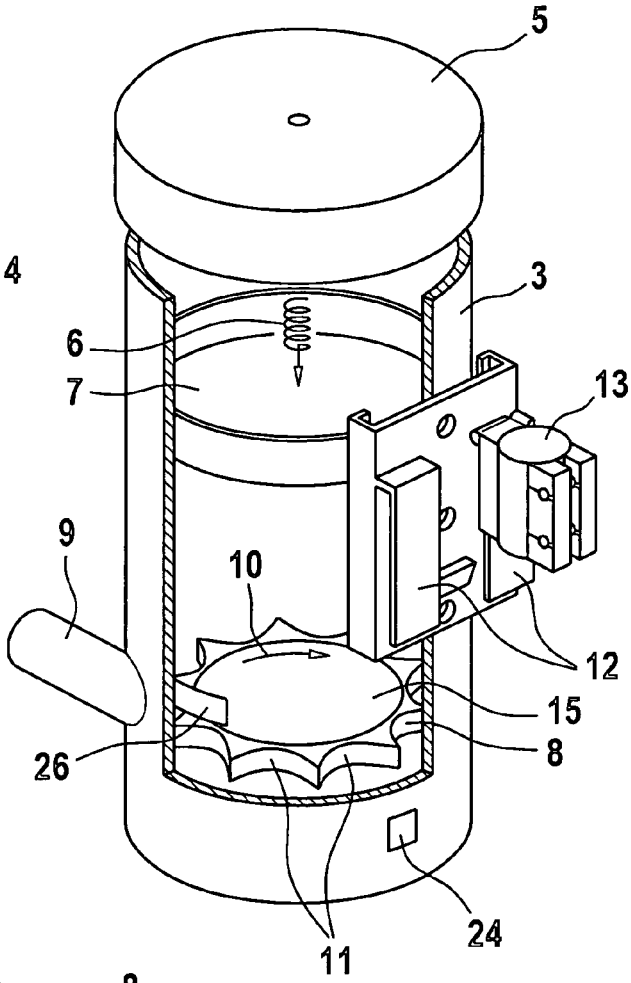
FIG. 2 shows the partially sectioned ball container and feeder.

According to FIG. 2, the ball container 3 is of a cylindrical shape and provided with a cover lid 5 connected with a pressure plate 7 via a schematically indicated tension spring 6. The pressure plate 7, under the impact from the spring 6, pushes the contents of the container away from the open end of the container, shut by the lid, to its other end. At this other end is the feeder 8 that feeds the balls into the discharge canal 9 of the ball container 3 which is connected to the input end of the feeder tube 2. The feeder 8 is driven by an electric motor (not shown) via a slip clutch 17, 18, 19 that will be described below. The motor is supplied with power from a battery (also not shown) that is arranged in a suitable place. The container can be hooked onto the belt 4 of the shooter by means of hooks 12. In addition, a connector device 13 can be provided for the optional attachment of the container 3 to the arm 1.

The pressure plate 7 ensures that the balls contained in the container can be fed into the feeder in any position of the container 3.

Figure 3:
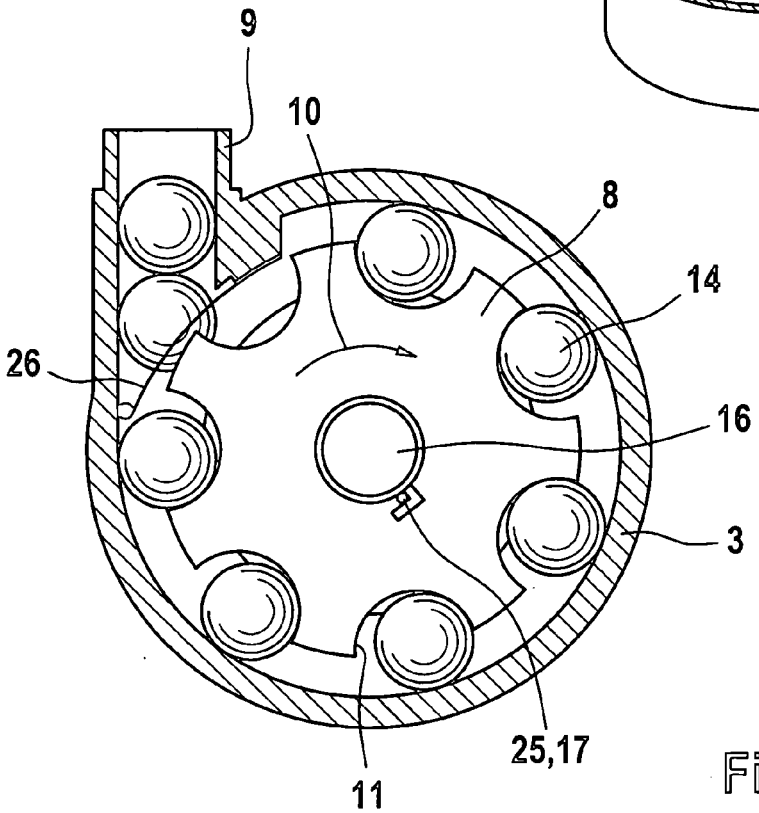
FIG. 3 shows a transversal section through the ball container, looking towards the feeder.

According to FIGS. 2 and 3, the container 3 is in the shape of a disk that is concentrically arranged in the cylindrical ball container 3. By rotating the feeder 8 in the direction of the arrow 10, the balls 14 in the feeder chambers 11 located at the periphery of the feeder 8 are fed into the discharge canal 9 of the ball container 3. The balls in the ball container 3 are pressed by the pressure plate 7 against the upper side of the feeder 8. The feeder 8 has a conical surface 15, so that the balls, under pressure from the pressure plate 7, are deviated outward to the feeding chambers 11. This ensures that the feeding chamber 11 from which a ball was fed into the discharge canal is immediately filled with a new ball. The rear part of the feeding chamber 11, which pushes the ball in the direction of the discharge canal 9, is preferably shaped in such a way that the ball is pushed simultaneously outward toward the wall of the ball container 3 and downward toward the bottom of the ball container, so that the ball moves along a defined path in the direction of the discharge canal 9.

Above the discharge canal 9 a flexible element 26 is fixed with its one end to the wall of the ball container 3. The lower end of the flexible element 26 is located at the same height as the upper end of the entrance to the discharge canal 9. A ball, which is not in the correct position within the feeding chamber 11 and projects over the upper end of the feeding chamber 11, touches the flexible element 26, before it is pushed against the edge of the feeder tube. The flexible element deflects the ball back into the ball container 3.

Figure 4:
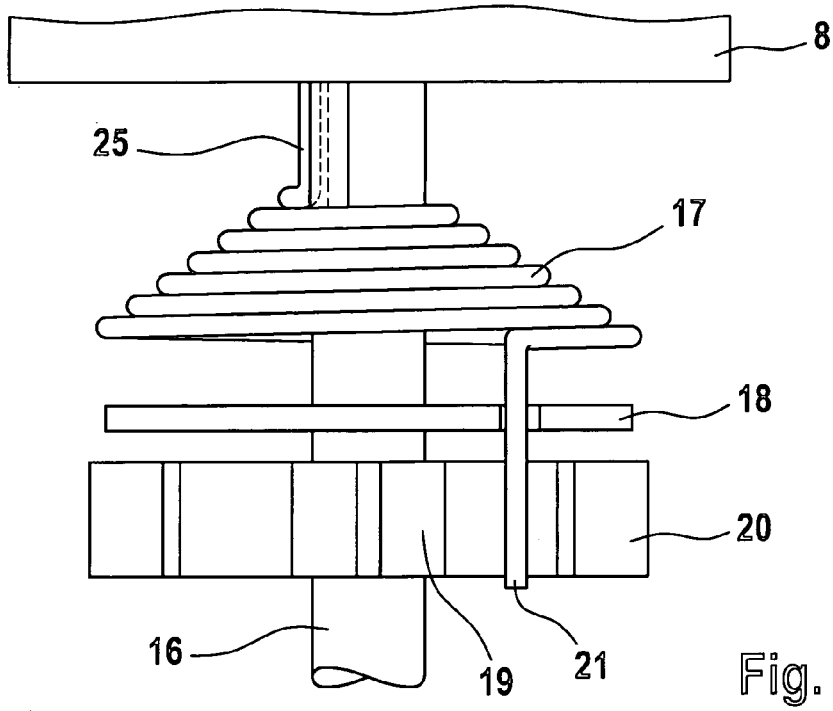
FIG. 4 shows a lateral view of the transmission between the drive motor and the feeder.

At the start of operation, the feeder 8 feeds balls in the direction of the discharge canal 9 until the feeder tube 2 is completely filled. When the feeder tube 3 is completely filled, the feeder 8 continues to exercise pressure on the series of balls, so that, under this pressure, the ball chamber of the arm 1 fills again immediately after a shot has been fired. The pressure exercised by the feeder 8 on the series of balls must be calculated in such a way as to be sufficient for feeding into the ball chamber, but must not be so great that the balls would explode from the pressure. For this purpose, the ball container 3 is equipped with the connection or clutch according to the invention as shown in FIGS. 4 to 6.

The drive motor (not shown) drives a drive shaft 16 on which are arranged, concentrically one on top of the other, a transmission element 19, a distance keeper 18, a spiral spring 17 and the feeder 8. The transmission element 19 is firmly connected with the drive shaft 16; the distance keeper 18, the spring element 17 and the feeder 8 are journaled on the drive shaft 16 in such a way that they can be freely rotated relative to the drive shaft 16. The spiral spring 17, being the spring element storing the energy necessary for feeding the balls, is connected with its inner end 25 with the feeder via a bayonet-like link.

Figure 5:
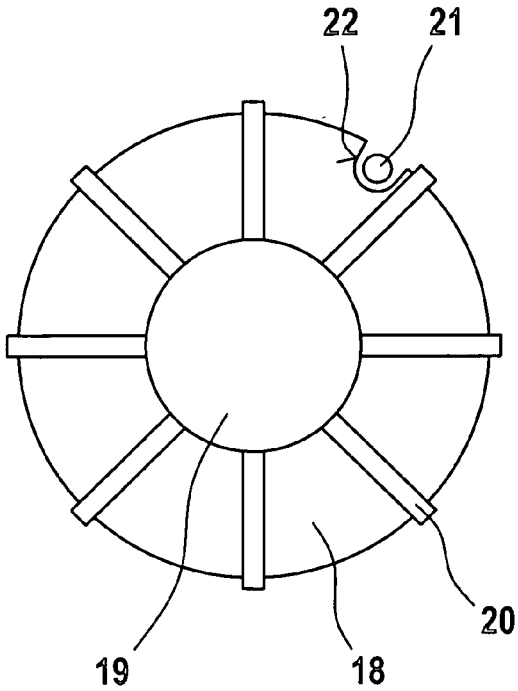
FIG. 5 shows a view of the connection or clutch from below.
Figure 6:
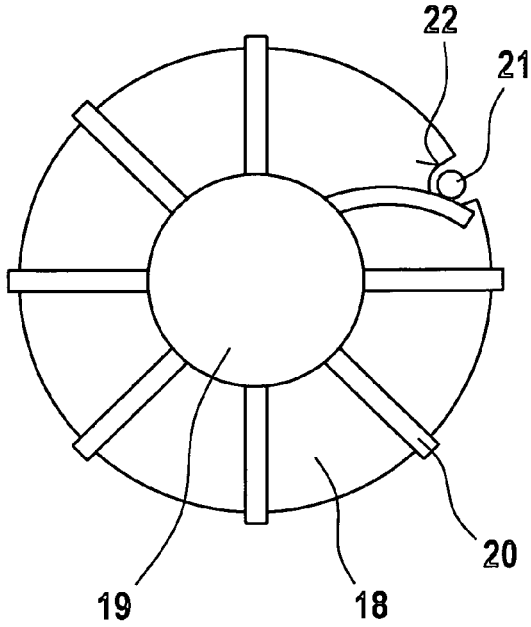
FIG. 6 shows the view in FIG. 5 in a different operating position of the connection or clutch.

As shown in FIGS. 5 and 6, the transmission element 19 is disk-like and comprises protrusions 20 that are arranged at the periphery of the disk.

At its outer end, the spiral spring 17 has a pin 21 which, being a protrusion, bears on one of the flexible protrusions 20 of the transmission element 19. When the shaft 16 is put in rotation by the motor, the flexible protrusion 20 of the transmission element 19 transmits this rotation to the pin. The feeder 8 is also put into rotation together with the spiral spring 17, feeding the balls 14 into the discharge canal 9 of the ball container. If the feeder tube 2 is filled with balls 14, both the feeder 8 and the spiral spring cannot rotate any further. The pin bears on the flexible protrusion 20 in a stable position; the remaining drive energy of the motor that is transmitted to the spiral spring 17 via the transmission element 19, is stored in the spiral spring 17. The spiral spring 17 coils up, thus decreasing the diameter of the coils. In order to avoid that the pin 21 is also pulled radially inward, the distance keeper 18 is arranged between the spiral spring 17 and the transmission element 19. The distance keeper 18 is in the shape of a disk and has a recess 22 in its periphery, in which the pin 21 comes to rest. The distance keeper 18 prevents the pin 21 from being pulled inward; the pin 21 always bears on the same position on the flexible protrusion 20.

While the spiral spring 17 is increasingly loaded by the rotating shaft 16, the force being transmitted by the flexible protrusion 20 to the pin 21 also increases. The flexible protrusion 20 bends under this load in the direction of the force. The position of the pin 21 relative to the flexible protrusion 20 in the case of a small force being transmitted is shown in FIG. 5, in the case of a large force, in FIG. 6. At a certain threshold value of the force, the flexible protrusion 20 is bent to such an extent that the pin 21 slips past it and, pushed by the energy stored in the spiral spring, jumps on to the next protrusion 20. The threshold at which the pin 21 starts slipping is calculated in such a way that the pressure exerted on the series of balls 14 in the feeder tube 2 by the feeder 8 is too small to damage the balls 14.

In order to save energy, the drive motor does not run continuously, but essentially only when balls 14 are being transported. For this purpose, a sensor 23 is arranged on an adapter 27 through which the feeder tube 2 is connected with the gun 1. The sensor 23 determines whether, at a given moment, balls 14 are being transported through the feeder tube 2. If no transport is taking place, the sensor 23 transmits a signal to the receiver 24 arranged on the ball container 3. The receiver 24 allows the motor to run for another 1 sec. in order to ensure that the spiral spring is fully loaded, and then switches off the drive motor. If the balls 14 start moving again through the feeder tube 2, the sensor 23 sends another signal to the receiver 24, where-upon the receiver 24 activates the motor once again.

If, in spite of this limitation of force, a ball 14 should explode, the contents of the ball is spilled across the bottom of the ball container 3. In order to restore the storage device to operability, the ball container 3 must be cleaned and the contents of the ball 14 wiped off. In order to facilitate the task, the feeder 8, as shown in FIG. 3, is detachably connected with the drive shaft 16. For this purpose, the feeder 8 is stuck on the drive shaft 16 from above. During this process, the inner end 25 of the spiral spring 17 locks like a bayonet into a recess in the feeder 8, thus preventing counter-rotation. The type of transmission element 19 described here, in which the flexible protrusions 20 are arranged at the periphery, is only one of several possible embodiments. Another option would be to give the entire transmission element a ring shape and to direct the protrusions inward or to direct the protrusions from the transmission element in an axial direction. It is also possible, within the frame of an equivalent solution, to arrange only one protrusion on the transmission element and to compensate by arranging a plurality on the spring element. In addition, depending on the purpose, it is possible to provide flexibility only to the protrusions of the spring element or to both the protrusions of the spring element and those of the transmission element.

The invention claimed is:

1. Device for storing projectile balls and feeding them into the projectile chamber of a gun, having a ball container, a feeder tube connected to it with its one end, whose other end is connected with the gun, and a motor-driven feeder for feeding balls from the ball container into the feeder tube, a spring element transmitting the traction from the motor to the feeder and the spring element storing at least that traction energy which is necessary for feeding one ball into the projectile chamber, characterized in that the device comprises a slip clutch for transmitting the traction from the motor to the feeder.

2. Device according to claim 1, characterized in that the slip clutch comprises a transmission element for traction having a plurality of protrusions, the protrusions being arranged at a distance from the axle of the transmission element and concentrically relative to said axle, in that the spring element has a protrusion for engaging the protrusions of the transmission element, and in that, in order to limit the torque transmittable from the transmission element to the spring element, the protrusions of the spring element and/or the transmission element are flexible.

3. Device according to claim 2, characterized in that the feeder can be detachably connected with the transmission element by means of a bayonet connection.

4. Device according to claim 2, characterized in that the feeder is a rotary feeder having its feeder chambers arranged at the periphery and having a conical elevation on its upper side.

5. Device according to claim 1, characterized in that it disposes of freely rotating distance keeper mounted on the same axle as the transmission element, which maintains the protrusion of the spring element essentially at a set distance from the axle.

6. Device according to claim 5, characterized in that the system for intermittently switching on is dependent on the movement of the balls in the feeder tube.

7. Device according to claim 5, characterized in that the feeder can be detachably connected with the transmission element by means of a bayonet connection.

8. Device according to claim 5, characterized in that the feeder is a rotary feeder having its feeder chambers arranged at the periphery and having a conical elevation on its upper side.

9. Device according to claim 1, characterized in that it comprises a flexible element above the feeder adjacent to the feeder tube, the flexible element being fixed to the ball container with its one end.

10. Device according to claim 9, characterized in that it comprises a sensor for detecting the movement of the balls in the feeder tube and that the sensor is arranged on the end of the feeder tube that is close to the hand gun.

11. Device according to claim 9, characterized in that the feeder can be detachably connected with the transmission element by means of a bayonet connection.

12. Device according to claim 9, characterized in that the feeder is a rotary feeder having its feeder chambers arranged at the periphery and having a conical elevation on its upper side.

13. Device according to claim 1, characterized in that there is a system for intermittently switching on the motor.

14. Device according to claim 13, characterized in that the feeder can be detachably connected with the transmission element by means of a bayonet connection.

15. Device according to claim 13, characterized in that the feeder is a rotary feeder having its feeder chambers arranged at the periphery and having a conical elevation on its upper side.

16. Device according to claim 1, characterized in that the feeder can be detachably connected with the transmission element by means of a bayonet connection.

17. Device according to claim 1, characterized in that the feeder is a rotary feeder having its feeder chambers arranged at the periphery and having a conical elevation on its upper side.

18. Device for storing balls and feeding them into the projectile chamber of a gun, having a ball container, a feeder tube connected to it with its one end, whose other end is connected with the gun and a motor-driven feeder for feeding balls from a ball container into the feeder tube, a spring element transmitting the traction from the motor to the feeder and the spring element storing at least that traction energy which is necessary for feeding one ball into the projectile chamber, characterized in that the feeder disposes of a bayonet connection with a transmission element for the feeder, which is under pressure from the spring.

19. Device according to claim 18, characterized in that the feeder is a rotary feeder having its feeder chambers arranged at the periphery and having a conical elevation on its upper side.

* * * * *